United States Patent [19]

Fiske

[11] 4,227,764

[45] Oct. 14, 1980

[54] CONNECTOR AND ADAPTER SYSTEM

[75] Inventor: Earl D. Fiske, Excelsior Springs, Mo.

[73] Assignee: Bunker Ramo Corporation, Oak Brook, Ill.

[21] Appl. No.: 958,479

[22] Filed: Nov. 7, 1978

Related U.S. Application Data

[63] Continuation of Ser. No. 798,781, May 20, 1977, abandoned.

[51] Int. Cl.[3] ..... H01R 13/60; H01R 25/06

[52] U.S. Cl. ..... 339/121; 174/58; 339/125 R; 339/156 R; 339/163; 339/218 M

[58] Field of Search ..... 339/92 R, 92 M, 97 R, 339/97 P, 99 R, 121, 122, 125, 132 R, 132 B, 154–156, 163, 164, 176 M, 198, 218 R, 218 M; 174/53, 58–60

[56] References Cited

U.S. PATENT DOCUMENTS

| | | | |
|---|---|---|---|
| 1,950,717 | 3/1934 | Douglas | 339/198 C |
| 2,195,975 | 4/1940 | Ribble et al. | 339/165 |
| 2,463,034 | 3/1949 | Harnett | 339/218 M |
| 3,086,251 | 4/1963 | Bernat | 339/218 M |
| 3,110,538 | 11/1963 | Rees et al. | 339/92 M |
| 3,218,597 | 11/1965 | Oehlerking et al. | 339/122 R |
| 3,683,314 | 8/1972 | Elkins | 174/59 |
| 3,705,378 | 12/1972 | Elkins | 339/156 R |
| 3,820,056 | 6/1974 | Ayer | 339/198 R |
| 3,876,276 | 4/1975 | Ayer | 339/156 R |

FOREIGN PATENT DOCUMENTS

| | | | |
|---|---|---|---|
| 228911 | 3/1959 | Australia | 339/198 C |
| 955432 | 4/1964 | United Kingdom | 339/218 M |

*Primary Examiner*—Neil Abrams

*Attorney, Agent, or Firm*—F. M. Arbuckle; P. D. Ertel

[57] ABSTRACT

An electrical connector assembly, a protective enclosure therefor and a running cable bridging adapter system which may use one or both of such components are disclosed. The connector assembly includes a pair of connectors electrically coupled back to back and mechanically secured in such relation by a protective support medium, such as epoxy, with at least one bolt receiving aperture extending through the support medium to facilitate compact stacking and mounting of plural connector assemblies in several alternative arrangements within the protective enclosure. The protective enclosure also includes a mounting plate having predetermined arrays of mounting points formed as prestressed punch-outs for enabling securance of the member and its supported connector assemblies to various electrical junction boxes or the like each having its own distinctive array of plural mounting points.

The running cable bridging adapter system utilizes plural connector assemblies as modular units for connecting plural wire subsets of a set of wires of an electrical input cable to preselected wires of a series of output cables.

7 Claims, 12 Drawing Figures

CONNECTOR AND ADAPTER SYSTEM

This is a continuation of application Ser. No. 798,781 filed May 20, 1977, now abandoned.

BACKGROUND OF THE INVENTION

The present invention relates generally to electrical connector assemblies, protective enclosures therefor and associated running cable bridging adapter systems. More particularly, the invention is directed to new and improved apparatus and systems of the aforesaid type which facilitate field installation of telephone sets and the like by utilization of easily installable standardized or modularized system components.

Historically telephone installation and repair has required the services of a skilled telephone technician who has been called upon to perform customized on-site wiring, splicing and assembly. Moreover, the proliferation of different species of telephone connector hardware has required that technicans be familiar with the peculiarities and wiring requirements for a maze of connectors, adapters and mounting enclosures, and that the telephone companies maintain correspondingly large part inventories. In an attempt to reduce rising labor and part inventory costs, the telephone companies have focused considerable emphasis on the development of standardized or modularized telephone cables, connectors, protective enclosures and adapters so that installations may efficiently and reliably be made by less skilled technicians than presently requied and so that required part inventories may be correspondingly reduced.

For example, in the installation of multiple telephones in an office complex or residence, it is already a familiar practice to provide a standard inventory of cables having various lengths and numbers of wire pairs with pre-wired and pre-assembled connectors of the male and female variety, respectively, at opposite ends of the cable. One type of connector often used in such assemblies is discl9sed in U.S. Pat. No. 3,760,335. Such standard cables typically include one or a multiple of sets of 25 wire pairs, although not all of the 25 wire pairs are utilized in each installation, such as in respect of a residential telephone unit or an office extension unit. It is therefore advantageous to make provision for simple and convenient utilization of the unused wire pairs. Additionally, it is not uncommon that the connector on the inplace equipment and the connector on the new equipment may both be male or female so as not to admit of direction interconnection. In this regard, it is known to provide a pair of connectors at each cable and usually arranged in a back to back relation. Examples of such connectors are shown in U.S. Pat. Nos. 3,705,378, 3,866,292, 3,876,276 and 3,963,300.

The connector assemblies above-described provide only a partial solution to equipment installation problems. There still remain the difficulties of mounting one or a series of the back to back connectors in an installation environment in a convenient, efficient manner, and particularly the adaptation of mounting units so as to interfit with different types of electrical junction boxes as required by various municipal codes throughout the United States. Additionally, the efficient use of cables including multiple sets of 25 wire pairs continues to pose field installation problems and component inventory problems since special connectors must be inventoried for each type of multiple wire cable.

SUMMARY OF THE INVENTION

Therefore in accordance with one aspect of the present invention there is provided a new and improved electrical connector assembly.

A further aspect of the present invention involves provision of a new and improved modular connector assembly that may easily and simply be mounted, singularly or in various arranged multiples, to a mounting member.

In accordance with yet another aspect of the present invention there is provided a new and improved mounting member which is easily adapted for securance to any one of the variety of electrical junction boxes presently in use.

An additional aspect of the present invention is to provide a new and improved protective enclosure for the connector assemblies of the invention and which enclosure provides the mounting facility both for the connector assemblies and for securance to the electrical junction boxes of various types.

Yet a further aspect of the present invention is to provide a new and improved bridging adapter system for cables including plural wire subsets thereby to facilitate use of such cable units.

One facet of the present invention relates to an electrical connector assembly for connecting each wire of a plural wire input cable to preselected wires of a pair of output cables or the like. The assembly includes first and second electrical connector means each having an input side composed of a plurality of first electrical contact portions and an output side composed of a plurality of second electrical contact portions coupled to the first contact portions. The second contact portions of each of the first and second electrical connector means are adapted for interconnection to respective mating connector means coupled to respective ones of the pair of output cables. Conductor means couples each wire of the input cable to respective first contact portions of each of the first and second electrical connector means while support means are provided for securing the first and second electrical connector means in a predetermined physical relation and for protectively enclosing the input sides of the connectors and the conductor means. A fastening means includes a bolt receiving aperture extending through the support means for enabling securance of the connector assembly singularly or in compactly stacked multiples to a mounting means.

In accordance with a further facet of the present invention, there is provided a protective enclosure for a connector assembly of the type comprising at least one connector element having a bolt receiving aperture extending through the assembly. The enclosure comprises a mounting means including a generally planar mounting member having predetermined arrays of individual punch-outs formed as pre-stressed areas of the mounting member for enabling securance of the mounting member to any one of a plurality of electrical junction boxes each having a predetermined, distinctive array of pluaral mounting points corresponding to the predetermined arrays of the individual punch-outs. The mounting means further includes at least one threaded aperture for threadably receiving a bolt disposed through the bolt receiving apertures of one or more of the connector assemblies to secure same to the mounting member. There is also provided a cover means having plural sidewalls and a top portion defining a receiving cavity for coacting with the planar mounting member to form an enclosure about the connector assembly.

Yet a further feature of the present invention is directed to a running cable bridging adapter system for electrically interconnecting plural wire subsets of a set of wires of an electrical input cable to preselected wires of a series of output cables or the like. The adapter system of the invention includes first and second electrical connector means each comprising plural electrical connectors corresponding in number to the subsets and each having an input side composed of a predetermined number of electrical contacts at least equal in number to the plural wires in each subset and an output side for connection to a mating connector coupled to one of the series of output cables. Conductor means are provided for coupling the wires of each subset to corresponding contacts of one each of the plural connectors of the first and second electrical connector means, respectively, to form respective pairs of the connectors of the first and second connector means coupled to the same wire subset. A support means secures each of the respective pairs of connector means in a predetermined physical relation and protectively encloses the input sides of the first and secnd electrical connector means and the conductor means.

BRIEF DESCRIPTION OF THE DRAWINGS

The novel features which are believed to be characteristic of the invention are set forth in the appended claims. The invention itself, however, together with further objects and attendant advantages thereof, will be best understood by reference to the following description taken in connection with the accompanying drawings, and in which:

DESCRIPTION OF THE PREFERRED EMBODIMENTS

Figure 1:
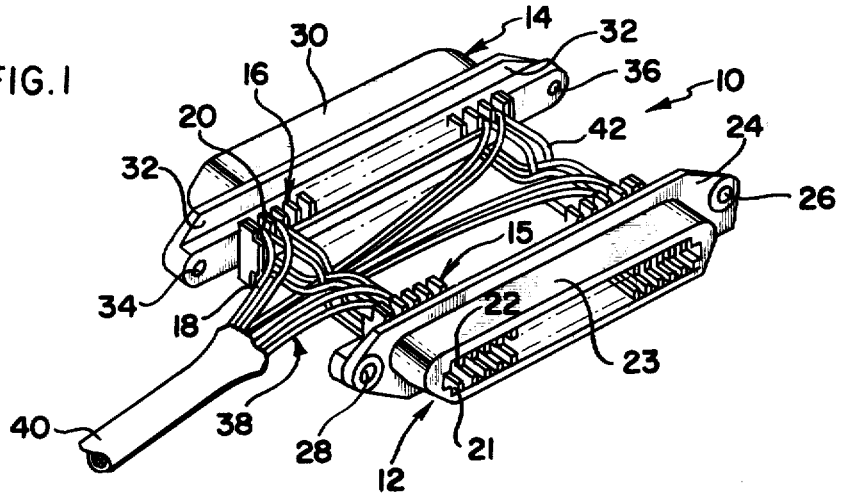
FIG. 1 is a perspective view of a connector assembly of the invention shown in a preliminary stage of fabrication.

Referring now to FIG. 1, the electrical connector assembly 10 of the invention is there depicted in a partially fabricated state to facilitate illustration and explanation of its several constituents. The assembly 10 is composed of first and second electrical connector means 12 and 14 respectively, each of which may be of conventional design such as that described in the previously identified U.S. Pat. No. 3,760,335. The structural details of the connectors 12 and 14 are not critical to the present invention, and may be varied considerably consistent with the principles of the invention. Accordingly, connectors 12, 14 are here described only to an extent necessary to enable a clear understanding of the invention.

The first and second electrical connector means 12 and 14 each include an input side composed of a plurality of first electrical contact portions identified generally by the reference numerals 15 and 16, respectively. Only a portion of the first electrical contact portions 15 and 16 are illustrated in detail for clarity and simplicity in the drawing. The connector means 12 and 14 further each include a plurality of second electrical contact portions of which only the second contact portions 18 of the connector 12 are visible in the drawing. The second contact portions 18 and the counterpart second contact portions of connector 14 (not visible in the drawing) are integrally formed with their respective, associated first contact portions and are adapted for interconnection in contact pairs to mating connector means as will be more fully explained hereinafter.

The similar connectors 12 and 14 may either be both of the male or the female type, or of opposite gender. However, in either event, the first contact portion 15, 16 of the connectors are each constituted of twenty-five separate contact pairs, exemplified by the input contact pairs 18, 20 of connector 14. A like number of output contact pairs are connected to associated ones of the input pairs of the connectors 12 and 14, exemplified by the output contact pair 21, 22 of connector 12 and the output contact pair 18', 20' of the connector 14. Each of the contact pairs such as the exemplary contact pairs identified above are mounted in electrically isolated relation in respective recess slots formed on the interior perimeter of a generally rectangular support flange 23. The flange 23 is in turn integral with a transverse peripheral plate portion 24 which is centrally apertured to pass the contact portions previously described and which includes at its remote ends tabular ear portions having respective bolt receiving apertures 26 and 28 for enabling securance of the connector 12 to a mating connector bolt, as will presently be described in further detail. Although not fully visible in the drawing, the connector 14 similarly includes a peripheral flange 30 for supporting and protectively enclosing its associated first contact portions and a transverse mounting plate 32 having respective apertures 34 and 36 at its remote ends for securance to a mating connector.

The connectors 12 and 14 are preferably oriented in a back-to-back relation as illustrated in FIG. 1 with the individual wires 38 of the plural wire input cable 40 directly connected in conventional fashion to the respective first contact portions 15 and 16 of the connectors 12 and 14, respectively. Corresponding second contact portions of connectors 12, 14 are interconnected by the shunt wires 42, only a portion of which are shown in FIG. 1 for the sake of clarity. The shunt wires 42 may be separate wire segments or, alternatively, may be an integral continuation of the individual cable wires 38.

Once the connector assembly of FIG. 1 has been appropriately wired, the structure is in condition for the next stage of assembly which involves provision of a support means for securing the connectors 12, 14 in a predetermined physical relation and protectively enclosing the inter-wired input sides of these connectors. Specifically, this is accomplished by placing the back-to-back connectors of FIG. 1 together in close proximity and suitably dressing the wires disposed therebetween so as to form a generally rectangular package of the outline of the completed connector assembly 10 of FIG. 2. In accordance with a preferred embodiment of the invention, the support means comprises a potting compound, such as epoxy, for forming an integrally molded enclosure 44 about the input sides 15, 16 of the connectors 12, 14 and for providing a strain relief coupling of the individual wires 38 of the cable 40 to the connector assembly. The potting compound 44 is intimately molded about the juxtaposed sides of the connectors 12, 14 so that the resultant assembly is of a generally rectangular configuration having planar and generally parallel top and bottom surfaces 44*a*, 44*b* defined by the molded potting compound 44. As is evident in FIG. 2, a protective sheath for the input cable 40 is drawn over the individual cable wires 38 and may terminate and be securely held within the one end portion of the support means formed by the potting compound 44. While the molded epoxy support structure described is presently preferred, it is to be understood that other types of molding compounds or non-molded structures may also be used, provided that the requisite support and strain relief is still obtained within a compact package.

Figure 2:
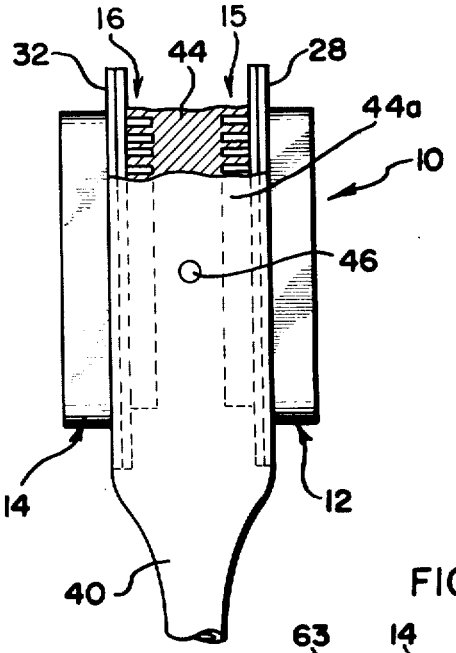
FIG. 2 is a top plan view of the connector assembly of the invention as fully fabricated.
Figure 3:
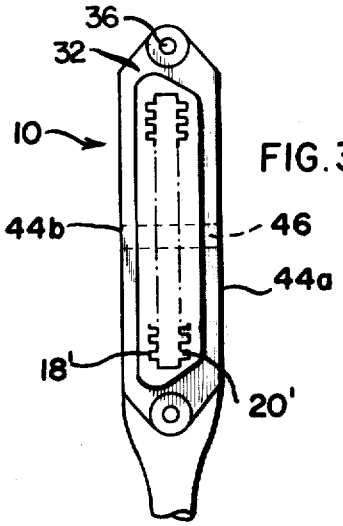
FIG. 3 is a side elevation of the connector assembly of FIG. 2.

The finished connector assembly 10 of FIG. 2 also includes a fastening means comprising one or more bolt receiving apertures 46 extending through the protective enclosure of the support means 44 thereby to enable securance of the connector assembly 10 to a mounting means presently to be described. The bolt receiving aperture 46, shown in dotted cross-section in FIG. 3, extends between the planar top 44*a* and planar bottom 44*b* of the support means 44. The central bore 46 of the support means 44 is preferably formed by locating a suitably dimensioned plug within the central portion of the support means during the assembly and molding procedure.

Figure 4:
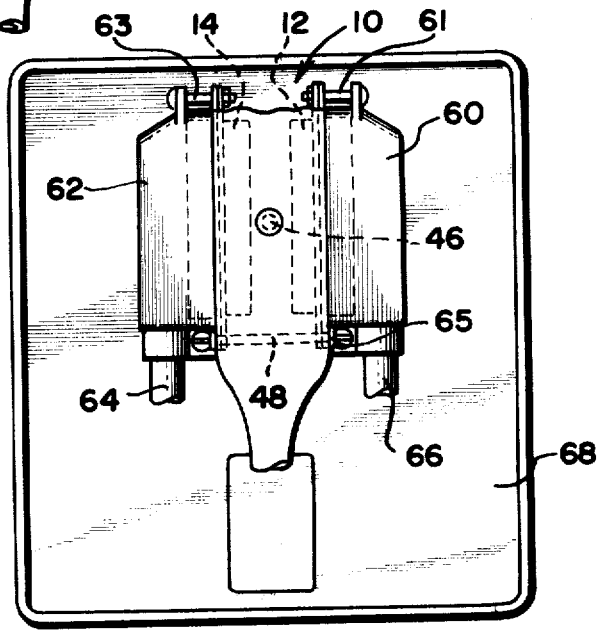
FIG. 4 is a top plan view of the connector assembly of FIG. 2 as secured to a mounting member of the invention and interconnected to a pair of mating connectors and their respective output cables.

The fastening means preferably further includes a further bolt receiving aperture 48 disposed in alignment with the opposed facing apertures 28 and 34 of the connectors 12 and 14, respectively. The bore 48 which is extended through the molded epoxy in the same manner as the bore 46 facilitates securance of the connector assembly 10 to a pair of mating connectors 60 and 62, as shown in FIG. 4. Specifically, and with reference to FIG. 4, the connector element 12 is secured in conventional fashion at its upper end in assembled relation to the mating connector 60 by a bolt 61. The connector 14 is similarly secured in a conventional manner to a mating connector 62 at its upper end by a bolt 63 disposed between the aligned, apertured flange members of the mating connectors. The mated connector pairs 12, 60 and 14, 62 are retained in assembled relationship at their lower ends by a bolt 65 and an associated nut which clamps the flanges of the connectors 12, 60 and 14, 62 in assembled relation.

As previously pointed out, it is understood that the connectors 12, 14 and, thus, the mating connectors 60, 62 may be of any appropriate gender to effect a proper interconnection in the intended environment of use. At any rate, the mating connectors 60 and 62 are coupled by respective output cables 64 and 66 either to individual telephone stations or to further connector assemblies as will be more particularly explained hereinafter.

Figure 5:
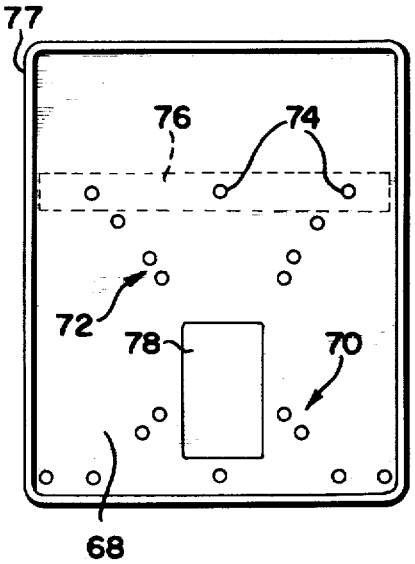
FIG. 5 is a perspective view of the mounting member which forms a part of a protective enclosure of the present invention, with the connector assembly of FIG. 4 removed to more clearly illustrate the mounting member construction.
Figure 6:
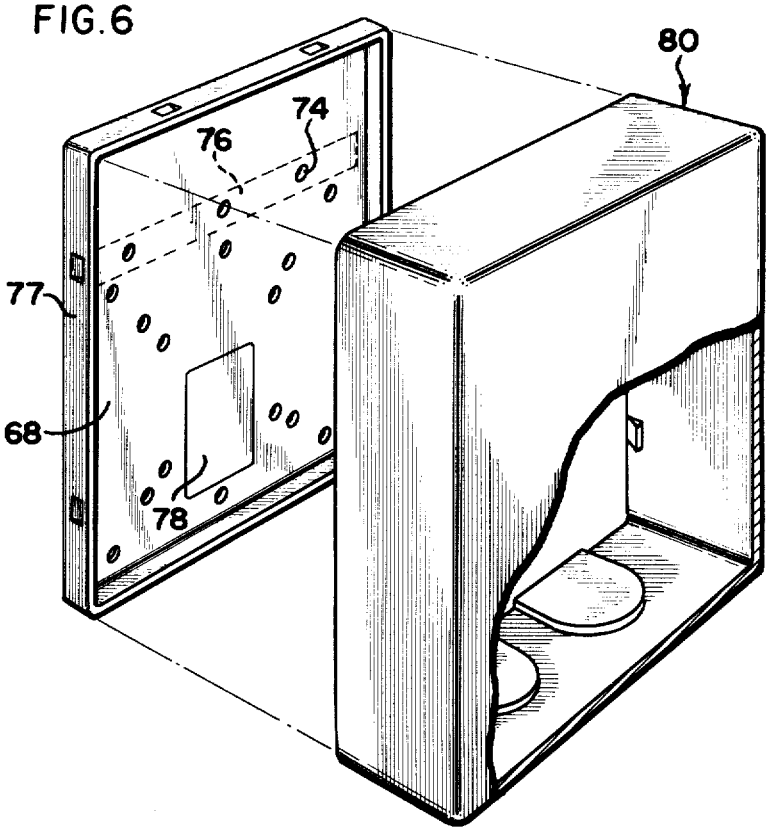
FIG. 6 is a perspective view of the cover portion of the protective enclosure of the present invention.

The connector assembly 10 is uniquely adapted by the aperture 46 of the fastening means and by its compact configuration to be mounted individually or in stacked arrays on planar mounting members, such as the planar mounting plate 68 of FIG. 4. The mounting member 68 comprises one component of a protective enclosure of the invention which is shown in greater detail in FIGS. 5 and 6. Specifically, as shown in FIG. 5, there is provided a mounting means including a generally planar mounting member 68 having predetermined arrays of individual punch-outs, such as those shown generally by the reference numerals 70 and 72 in the figure. The punch-outs 70, 72 are formed as prestressed areas of the mounting member 68 to facilitate their selective removal. The individual arrays of punch-outs 70 and 72 are strategically arranged on the mounting member 68 so as to enable the mounting member to be affixed to any one of a plurality of electrical junction boxes or the like each of which may have a corresponding predetermined and distinctive array of plural mounting points. In this regard, the various construction codes throughout the United States specify different standards for electrical junction boxes thereby posing problems in mounting conventional telephone enclosures to the electrical junction boxes. The present invention obviates this problem by providing several arrays that may be conveniently matched to the particular junction box in the environment of use.

The mounting member 68 further includes at least one threaded aperture 74 for threadably receiving one or more bolts that have been disposed through corresponding bolt apertures in the mounted connectors, e.g., aperture 46 in the connector assembly 10. In the present embodiment, there are illustrated three such bolt receiving apertures 74 disposed in a straight line across the upper half of the mounting plate 68. Each of the threaded apertures 74 is preferably formed in a rectangular, metal stiffening plate 76 which is preferably molded into the plastic mounting member 68 thereby to provide improved retention strength.

The planar mounting member 68, in addition to the arrayed punch-outs 70 and 72 and the threaded mounting apertures 74, further includes at least one enlarged punch-out 78 which is of a size when removed to pass a cable, such as the input cable 40 of the connector assembly 10.

The protective enclosure for mounting one or more of the connector assemblies 10 further includes a cover means 80 having plural sidewalls and a transverse top portion collectively defining a rectangular receiving cavity and conventionally arranged for coacting with an upstanding peripheral flange portion 77 of the planar mounting member 68 to form a snap-fitted releasable enclosure. The depth of the cover may be dimensioned so as to snugly accommodate a preselected stacked number of the assemblies 10, or several different covers of varied depths may be available for use according to the number of assemblies to be stacked within the enclosure. Various punch-outs may also be provided in one or more of the sidewalls of cover 80 to enable the connector cables to be conveniently inserted into the protective enclosure at desired locations while otherwise maintaining the integrity of the enclosure.

Figure 8:
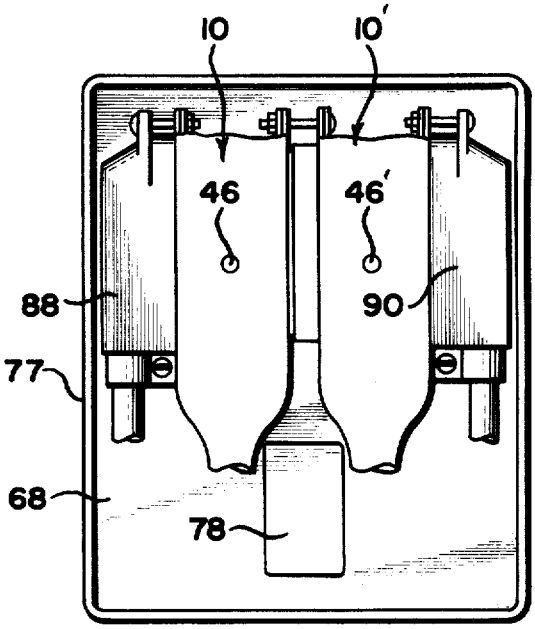
FIG. 8 illustrates an exemplary manner of mounting a pair of connector assemblies of the present invention to the mounting member of FIG. 5.
Figure 9:
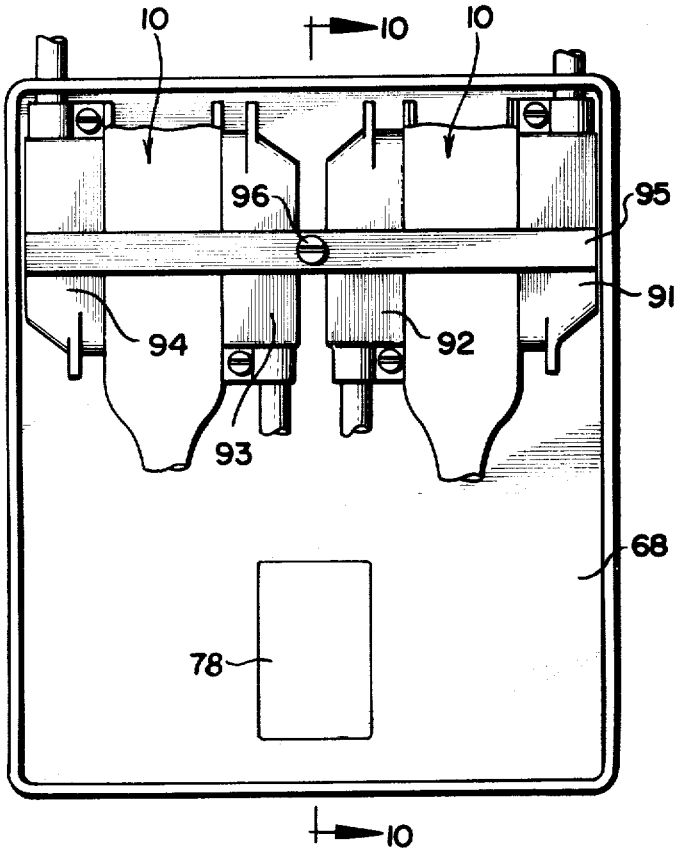
FIG. 9 illustrates another alternative for mounting multiple connector assemblies to the mounting member of FIG. 5.
Figure 10:
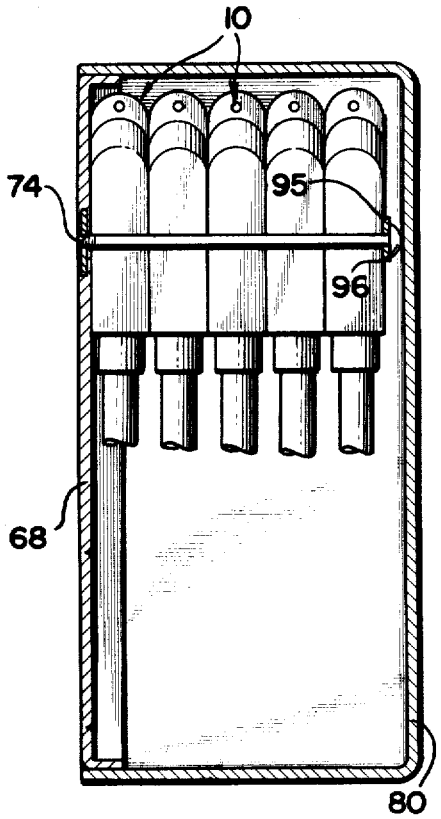
FIG. 10 is a cross-sectional view taken along lines 10—10 of FIG. 9 depicting the manner in which multiple connector assemblies may be compactly mounted in stacked relation within the protective enclosure of the present invention.

Plural connector assemblies 10 may be secured to the mounting member 68 in various arrangements, as may more precisely be understood by reference to FIG. 4 and to FIGS. 8 through 10. As shown in FIG. 4, a single connector assembly 10 to which there has been secured mating connectors 60 and 62 oriented with their associated output cables both extending downwardly is secured simply and directly to the mounting member 68 by a bolt disposed through the central aperture 46 of the assembly. A series of connector assemblies 10 may be stacked in a vertical array to a preselected maximum depth of three or five in number, as seen, for example, in FIG. 10. To facilitate stacking of a variable number of connector assemblies 10 within the protective enclosure while still maintaining a compact external package, it is contemplated that plural covers 80 be provided having differing depths corresponding to a preselected number of connector assemblies to be stacked.

Other arrangements for mounting the connector assemblies 10 on the mounting member 68 are illustrated in FIGS. 8, 9 and 10. As shown in FIG. 8, a connector assembly 10 composed of a pair of female connector elements is interconnected to the male connector component of an otherwise similar connector assembly 10'. The composite assembly thus defined is mounted by the respective mounting bolts passing through holes 46 and 46' and threaded to respective ones of the threaded apertures 74 of the mounting plate 68. Mating connectors 88 and 90 are connected to the respective remaining connector elements of the connector assemblies 10 and 10' and by these mating connectors to respective output cables. The several mating connectors are securely retained in assembled relation by clamping bolts similar to the bolts 61, 63 and 75 described in conjunction with FIG. 4.

A further alternative for arranging and mounting the connector assemblies is shown in FIGS. 9 and 10. In the arrangement there depicted, a pair of like connector assemblies 10 are mounted in laterally spaced relation on the mounting plate 68, and each is connected to a pair of mating connectors 91, 92 and 93, 94, respectively, in a manner similar to that previously described in conjunction with the mounting of the single connector assembly 10 of FIG. 4. However, in the present instance the mating connector pairs 91, 92 and 93, 94 are oriented so that their associated output cables extend in opposite directions. As a further distinction from the FIG. 4 arrangement, the connector assemblies 10 are secured to the mounting member 68 by a bracket 95 and a bolt 96 which is threaded to a central aperture 74 of the mounting member 68. The bracket 95 may include additional apertures (not shown) which align with the central aperture 46 in the respective connector assemblies 10 thereby to provide additional locations for securely bolting the assemblies 10 to the mounting member 68.

Figure 7:
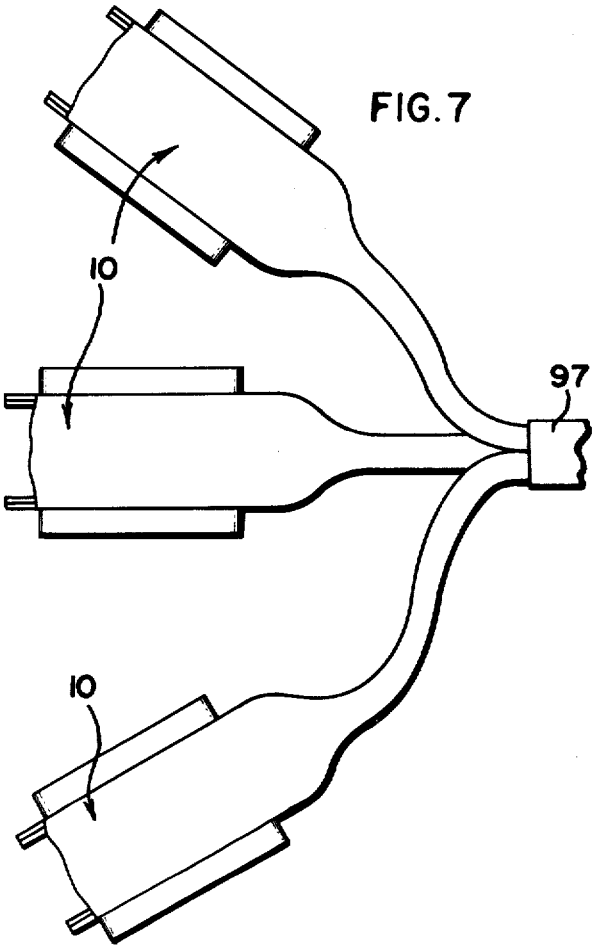
FIG. 7 illustrates the connection of three connector assemblies of the present invention to a main cable having a corresponding number of cable subsets.

Referring now to FIG. 7, there is shown an arrangement for utilizing the connector assembly 10 as a standard or modular unit to terminate cables having a multiple of a standard number of wire pairs. Specifically, as shown in FIG. 7 the set of wires composing cable 97 (i.e., 75 wire pairs) are divided into three wire subsets of 25 wire pairs each and each subset is connected to a respective one of the connector assemblies 10 in the manner previously described. The several connector assemblies 10 of FIG. 7 may all be identical as shown or they may be composed of various combinations of male and female connector elements, depending upon the application. The use of standard connector assemblies with input cables containing multiple subsets of wire pairs facilitates, for example, the installer's task in the wiring of running cable bridging adapters in the installation of telephone systems, as will presently become apparent in connection with FIGS. 11 and 12. Moreover, the similar individual connector units may be mounted in a stacked or other interrelated fashion in a protective enclosure of the invention. And the modular approach enables assembly and mounting of the individual connector assemblies 10 in a variety of different modes that are adapted to the exigencies of a particular installation environment.

Figure 11:
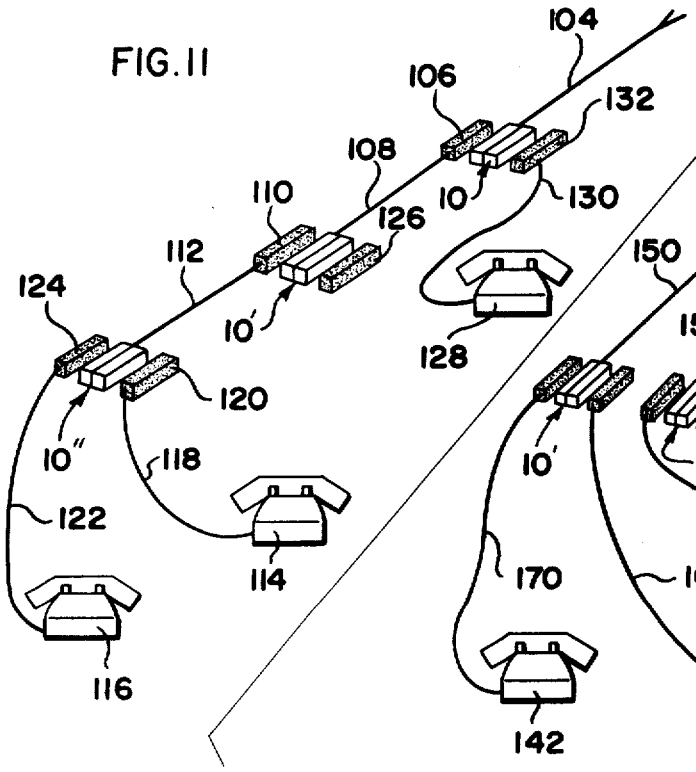
FIGS. 11 and 12 are schematic diagrams illustrating the manner in which connector assemblies of the invention may be advantageously utilized in running cable adapter systems in accordance with further teachings of the invention.

Referring now to FIG. 11, there is shown, in a schematic diagrammatic form, a first example of a telephone bridging adapter system utilizing the structure of the present invention. In describing FIGS. 11 and 12, it will be understood that the white blocks having a central dividing line denote a connector assembly 10, while the darker blocks denote a mating connector of opposite gender. More specifically with reference to FIG. 11, a running cable input 104 having a standard number of wire pairs (e.g., 25 wire pairs) is terminated in an electrical connector assembly 10. One output side of assembly 10 is connected through the male connector 106 and a further running cable 108 to a second connector assembly 10'. A mating connector 110 for the connector 10' is coupled to a further section of running cable 112 which ultimately terminates in the connector 10''. The two outputs of connector 10'' are in the present example coupled to respective telephone stations 114 and 116 through respective cable sections 118 and 122 and mating connectors 120 and, 124, respectively. A male connector blank 126 is coupled to the remaining output of the connector assembly 10' to provide a vacant station for expansion of the telephone extension network. A first pick-off of the running cables 104, 108, 112 available at the connector 10 is coupled to a telephone station 128 through an associated cable section 130 and a connector element 132.

Thus, as seen in the simplified bridging adapter system of FIG. 11, the connector assemblies 10, 10' and 10'' and their associated preselected cable lengths 104, 108 and 112 enable a comparatively unskilled technician to simply and efficiently wire a telephone extension network. Each of the connector assemblies may be mounted in the building electrical or utility duct work system in the manner previously described by use of the protective enclosure of the invention.

Figure 12:
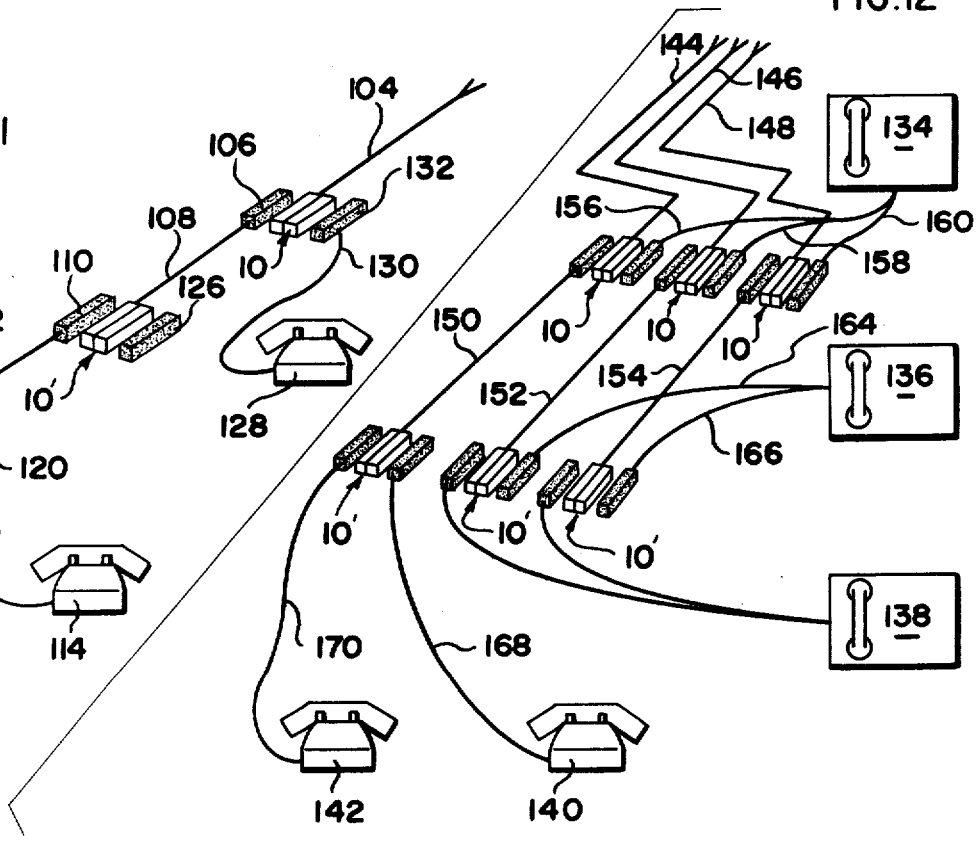

The bridging adapter system of FIG. 12 illustrates a somewhat more sophisticated system involving multiple line phones 134, 136 and 138 as well as a pair of conventional extension telephones 140 and 142. In this schematically depicted installation, a 75 wire pair input line is composed of three subset lines of 25 wire pairs 144, 146 and 148 each of which is connected to a respective connector element 10 in a manner similar to that shown in FIG. 7. One output of each of the connectors 10 is coupled to a respective second connector assembly 10' through respective cable sections 150, 152 and 154, each being selected from an inventory of standard length cable-connector arrangements. Each of the remaining connector outputs of the connector assemblies 10 are coupled to the multiple line phone 134 by respective male connectors and cable sections 156, 158 and 160, respectively. Similarly, a pair of multiple-line telephones 136, 138 which require fewer service functions than the telephone 134 are connected in parallel to outputs of two of the connectors 10' through the mating male connectors and cable sections such as 164, 166. Simple extension telephones 140 and 142 are connected by the connector and cable sections 168, 170 respectively to the remaining connectors 10'.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. An electrical connector assembly for connecting each wire of a plural wire input cable to preselected wires of a pair of output cables or the like, comprising:

first electrical connector means having an input side composed of a plurality of first electrical contact portions and an output side composed of a plurality of second electrical contact portions coupled to said first contact portions and adapted for interconnection to a mating connector means coupled to one of said pair of output cables;

second electrical connector means having an input side composed of a plurality of first electrical contact portions and an output side composed of a plurality of second electrical contact portions coupled to said first contact portions and adapted for interconnection to a mating connector means coupled to the other of said pair of output cables;

said input sides of first and second electrical connector means being spaced apart and oriented toward each other;

support means including a molded protective enclosure between said first and second electrical connector means about said input sides thereof to secure said first and second electrical connector means relative to each other in a predetermined physical relation;

conductor means for coupling each wire of said input cable to respective first contact portions of each of said first and second electrical connector means;

said molded protective enclosure providing a strain relief coupling of said wires of said input cable to said conductor means; fastening means for enabling securance of said connector to a mounting means, including a fastener-receiving aperture extending through said molded protective enclosure of said support means between said first and second electrical connector means;

mounting means comprising a mounting member having at least one threaded aperture for threadably receiving a fastener element disposed through said fastener-receiving aperture of said fastening means to thereby secure said connector assembly to said mounting member; and, said mounting member having a predetermined array of individual punch-outs to facilitate securance of said mounting member to an electrical connector box having plural mounting points corresponding to at least selected ones of said array of individual punch-outs.

2. The electrical connector assembly of claim 1 in which said mounting member has a generally planar plate and in which said punch-outs are formed as prestressed areas of said plate.

3. The electrical connector assembly of claim 2 in which at least one of said punch-outs is of a size when removed to pass said input cable therethough.

4. A protective enclosure for a connector assembly of the type comprising a plurality of connector elements each having a fastener receiving aperture extending therethrough, said connector elements being stacked in at least one stack with said fastener receiving apertures of each stack in alignment for receiving a fastener to secure said stacked connector elements to said enclosure, said enclosure comprising:

mounting means including a generally planar mounting member having predetermined arrays of individual punch-outs formed as prestressed areas of said mounting member for enabling securance of said mounting member to any one of plurality of electrical connector boxes each having a predetermined, distinctive array of plural mounting points corresponding to said predetermined arrays of said individual punch-outs and including a metal reinforcing strip having a plurality of apertures, each aperture being adapted for receiving a fastener disposed through said fastener receiving apertures in said stacked connector elements, each of said apertures in said strip being spaced from one another sufficiently to receive respective stacks of connector elements with the fastener receiving apertures of the connector elements of each stack and respective apertures being aligned to receive respective fasteners for securing said stacks of connector elements to said mounting members; and cover means having plural side walls and a top portion defining a receiving cavity of a depth corresponding to the thickness of said stacked connector elements for coacting with said planar mounting member to form an enclosure about said connector assembly.

5. The protective enclosure of claim 4 in which said planar mounting member further includes at least one punch-out which is of a size when removed to pass through a cable adapted for connection to at least one of said connector elements.

6. The protective enclosure of claim 5 in which said planar mounting member and said cover means are formed of a resilient plastic material.

7. In an electrical connector assembly of the type including a pair of individual connectors each having an input side and an output side, said connectors being oriented in spaced relation with their input sides confronting each other and their output sides facing in opposed directions, an input cable, conductor means electrically connecting said input cable to said input side of said individual connectors, and means positioned between said individual connectors for supporting said connectors in spaced relation and enclosing said conductor means; the improvement wherein:

said supporting and enclosing means are formed with a pair of opposed substantially planar exterior walls extending across said space between said individual connectors, and has an aperture formed therein which extends entirely through said supporting and enclosing means in a direction substantially perpendicular to said pair of planar walls for receiving an elongated fastener element, whereby said connector assembly may be stacked wall-to-wall with a second connector assembly of like construction, or mounted flush against a mounting surface, and secured thereto by means of said fastener element, while said output sides are both accessible to the mating connectors of respective output cables without interference from said second connector assembly, or from said mounting surface, against which said first connector assembly may be stacked or mounted; and said supporting and enclosing means comprises a block of rigid polymeric material engulfing said connector input sides, said conductor means, and the adjacent end of said input cable whereby to provide strain relief therefor; said fastener-receiving aperture extending through said rigid block and being surrounded by said polymeric material whereby to isolate said conductor means from said fastener element when the latter is received within said aperture.

* * * * *